US010830254B2

(12) United States Patent
Goto

(10) Patent No.: US 10,830,254 B2
(45) Date of Patent: Nov. 10, 2020

(54) BLOWER AND AIR CONDITIONING APPARATUS HAVING THE SAME

(71) Applicant: SAMSUNG ELECTRONICS CO., LTD., Suwon-si (KR)

(72) Inventor: Shinji Goto, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 109 days.

(21) Appl. No.: 15/977,538

(22) Filed: May 11, 2018

(65) Prior Publication Data

US 2018/0335055 A1 Nov. 22, 2018

(30) Foreign Application Priority Data

May 12, 2017 (JP) ..... 2017-096039
Mar. 30, 2018 (KR) ..... 10-2018-0037531

(51) Int. Cl.
*F04D 29/68* (2006.01)
*F04D 29/38* (2006.01)
(Continued)

(52) U.S. Cl.
CPC ..... *F04D 29/687* (2013.01); *F04D 29/164* (2013.01); *F04D 29/384* (2013.01);
(Continued)

(58) Field of Classification Search
CPC ..... F04D 29/164; F04D 29/384; F04D 29/40; F04D 29/52; F04D 29/522; F04D 29/526; F04D 29/66; F04D 29/68; F04D 29/681; F04D 29/687; H05H 1/2406; H05H 2001/2412; H05H 2001/2418;
(Continued)

(56) References Cited

U.S. PATENT DOCUMENTS

2009/0065064 A1 3/2009 Morris et al.
2010/0284780 A1* 11/2010 Wadia ..... F04D 27/001 415/1
(Continued)

FOREIGN PATENT DOCUMENTS

EP 2 884 823 A 6/2015
JP 2008291798 A * 12/2008
(Continued)

OTHER PUBLICATIONS

JP-2008291798-A MachineTranslation, Dec. 2008 [Retrieved Oct. 2019] (Year: 2008).*
(Continued)

*Primary Examiner* — Courtney D Heinle
*Assistant Examiner* — Elton K Wong
(74) *Attorney, Agent, or Firm* — Staas & Halsey LLP

(57) ABSTRACT

A blower having high efficiency and low noise by actively controlling airflow in the blower, and an air conditioner having the blower is provided. The air conditioner has a blower. The blower includes a fan having a hub and at least one blade provided on an outer circumferential surface of the hub, a motor to rotatably drive the hub, a shroud configured to surround the periphery of the fan and at least one actuator installed in the shroud and configured to form an airflow along an inner circumferential surface of the shroud.

20 Claims, 15 Drawing Sheets

(51) Int. Cl.

| | |
|---|---|
| ***F04D 29/52*** | (2006.01) |
| ***H05H 1/24*** | (2006.01) |
| ***F04D 29/16*** | (2006.01) |
| ***F15D 1/00*** | (2006.01) |

(52) U.S. Cl.
CPC ..... *F04D 29/526* (2013.01); *H05H 1/2406* (2013.01); *F05B 2240/30* (2013.01); *F05B 2260/96* (2013.01); *F05B 2270/20* (2013.01); *F05D 2240/307* (2013.01); *F05D 2270/172* (2013.01); *F15D 1/0075* (2013.01); *H05H 2001/2412* (2013.01); *H05H 2001/2425* (2013.01)

(58) Field of Classification Search
CPC ..... H05H 2001/2425; F05D 2240/307; F05D 2270/172; F15D 1/0075; F01D 11/10; F01D 11/14; F01D 11/16; F01D 11/18; F05B 2240/30; F05B 2260/96; F05B 2270/20
See application file for complete search history.

(56) References Cited

U.S. PATENT DOCUMENTS

2010/0329838 A1 12/2010 Greenblatt
2011/0200445 A1* 8/2011 Takeda ..... F04D 29/38 416/223 R
2012/0039731 A1* 2/2012 Sadi ..... F04D 29/164 417/423.7
2015/0267727 A1* 9/2015 Segawa ..... F04D 29/681 313/231.31
2017/0130723 A1 5/2017 Kosaka et al.

FOREIGN PATENT DOCUMENTS

| | | |
|---|---|---|
| JP | 2012-189215 A | 10/2012 |
| JP | 2014-103094 | 6/2014 |
| JP | 2017-053261 | 3/2017 |
| JP | 2017-065463 | 4/2017 |
| KR | 10-2012-0023319 | 3/2012 |
| KR | 10-2014-0068840 | 6/2014 |

OTHER PUBLICATIONS

PCT International Search Report issued Office Action in PCT International Application No. PCT/KR2018/005435 dated Sep. 13, 2018 (3 pages total).
Extended European Search Report dated Apr. 15, 2020 from European Application No. 18797937.2, 8 pages.

* cited by examiner

AIRFLOW FORMED AROUND THE BLADE
BY APPLYING THE PLASMA ACTUATOR

AIRFLOW FORMED AROUND THE BLADE BY APPLYING THE PLASMA ACTUATOR

BLOWER AND AIR CONDITIONING APPARATUS HAVING THE SAME

CROSS-REFERENCE TO RELATED APPLICATION(S)

This application is based on and claims priority under 35 U.S.C. § 119 to Korean Patent Application No. 10-2018-0037531, filed on Mar. 30, 2018, in the Korean Intellectual Property Office, and Japanese Patent Application No. 2017-0960391 filed on May 12, 2017 in the Japanese Intellectual Property Office the disclosures of which are incorporated by reference herein in their entirety.

BACKGROUND

1. Fields

The present disclosure relate to a blower having a propeller fan installed in an air conditioner.

2. Description of the Related Art

In recent years, an air conditioner has been required to have high efficiency and low noise. In addition, as a semi-permanent problem in a propeller fan, there is reduction of vortex at an end of a blade caused by a speed difference between the blade and a shroud that is a stationary object.

In order to solve these problems, studies have been conducted to optimize the shape of the blade or the shape of the shroud surrounding the periphery of the propeller fan by a conventional passive method.

However, there is a limit to realize high efficiency and low noise of the blower by the passive method.

On the other hand, there is a blower including a plasma actuator disclosed in Japanese Patent Publication No. 2014-103094 in order to actively solve the above problem by controlling the flow of air in the blower.

That is, the blower disclosed in Japanese Patent Publication No. 2014-103094 includes a turbine formed of a metal material, a cylindrical shroud surrounding the turbine, and a plasma actuator provided on an outer circumferential end of the turbine blade and an inner circumferential surface of the shroud.

The plasma actuator includes a power source for applying a high-voltage, high-frequency alternating-current voltage between an insulated coating wire of a coil shape installed along the circumferential direction on the inner surface of the shroud and an outer peripheral end of the blade. When plasma is generated in the gap between the outer peripheral end of the blade and the insulated coating wire by the plasma actuator, an induced airflow that flows toward the radial direction of the propeller fan is generated by the plasma. The induced flow flowing in the radial direction suppresses leakage flow at the outer peripheral end of the blade.

However, in the plasma actuator disclosed in Japanese Patent Publication No. 2014-103094, the material of the propeller fan must be metal.

Further, in order to generate plasma by the plasma actuator, the clearance between the outer circumferential end of the propeller fan and the inner circumferential surface of the shroud must be set very small. Therefore, an assembly error between the propeller fan and the shroud must be strictly controlled and the manufacturing cost is greatly increased.

Therefore, the technique described in Japanese Patent Publication No. 2014-103094 has a limitation in applying to general air conditioners in which the manufacturing cost is strictly limited and the material of the propeller fan is limited to a resin material.

Further, since the induced airflow generated in the plasma actuator flows in the radial direction, the induced airflow flows to a portion of the outer peripheral end of the blade. As a result, unintended disturbance or vortex occurs. The airflow flowing through the blade surface does not sufficiently flow at the outer peripheral end having the fastest velocity, so that even if the leakage flow can be suppressed, the blade cannot be utilized as efficiently as possible.

SUMMARY

Therefore, it is an aspect of the present disclosure to provide a blower having high efficiency and low noise by actively controlling airflow in the blower, and an air conditioner having the blower.

It is another aspect of the present disclosure to provide a blower in which a plasma actuator is installed at a low cost and an air conditioner having the blower.

In accordance with an aspect of the present disclosure, an air conditioner has a blower, the blower comprises a fan having a hub and at least one blade provided on an outer circumferential surface of the hub; a motor to rotatably drive the hub; a shroud configured to surround the periphery of the fan; and at least one actuator installed in the shroud and configured to form an airflow along an inner circumferential surface of the shroud.

The actuator may include a pair of electrodes; and a dielectric disposed between the pair of electrodes.

The pair of electrodes may include a first electrode provided on an inner circumferential surface of the shroud and a second electrode embedded in the inside of the shroud.

The first electrode and the second electrode may be alternately arranged along the circumferential direction of the shroud.

The first electrode may protrude from the inner circumferential surface of the shroud.

The second electrode may be disposed outside the first electrode along the radial direction of the shroud.

A plurality of the actuators may be spaced apart from each other along a circumferential direction of the shroud.

The air conditioner may further comprise a plurality of power sources to apply a voltage to each of the plurality of actuators; and a control unit to control the plurality of power sources. The control unit may be configured to independently control the plurality of power sources.

The control unit may be configured to apply a voltage to a power source nearest to an outer peripheral end of the fan when the fan rotates.

The first electrode and the second electrode may be disposed so as to overlap each other at least in a section along the circumferential direction of the shroud.

The first electrode may extend obliquely with respect to a direction of a rotation axis of the hub.

The first electrode may extend in parallel with an outer peripheral end of the blade.

The first electrode may be disposed obliquely with respect to the inner circumferential surface of the shroud.

The shroud may include a receiving groove to receive at least a portion of the first electrode.

The pair of electrodes and the dielectric may be aligned in the axial direction of the hub.

The shroud may include a bell mouth formed in a cylindrical shape; a flow reducing portion provided on an upstream side of the bell mouth to reduce a flow path area;

and a diffuser provided on a downstream side of the bell mouth to enlarge a flow path area.

The actuator may be provided on an inner peripheral surface of the bell mouth.

The actuator may be a plasma actuator configured to generate plasma by a dielectric barrier discharge (DBD).

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
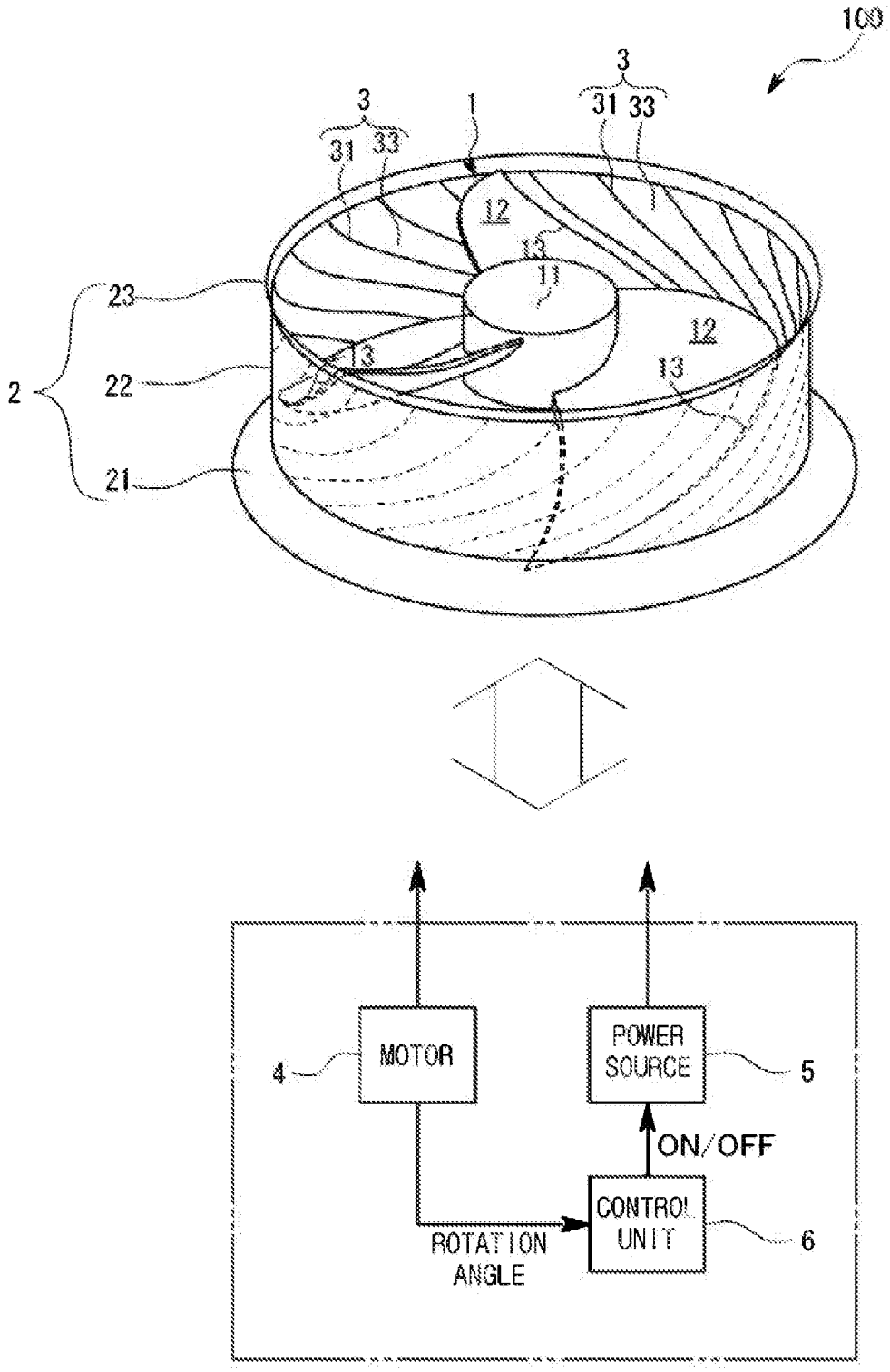
FIG. 1 is a perspective view and a functional block diagram illustrating a blower according to a first embodiment of the present disclosure.

The embodiments described herein and the configurations shown in the drawings are only examples of preferred embodiments of the present disclosure, and various modifications may be made at the time of filing of the present application to replace the embodiments and drawings of the present specification.

In addition, the same reference numerals or symbols shown in the drawings of the present specification indicate components or components that perform substantially the same function.

Throughout the specification, the terms used are merely used to describe particular embodiments, and are not intended to limit the present disclosure.

As used herein, the singular forms "a," "an" and "the" are intended to include the plural forms as well, unless the context clearly indicates otherwise.

Also, it is to be understood that the terms such as "include," "have," or the like, are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It is also to be understood that terms including ordinals such as "first," "second" and the like used herein may be used to describe various elements, but the elements are not limited to the terms, it is used only for the purpose of distinguishing one component from another. For example, the first component may be referred to as a second component, and similarly, the second component may also be referred to as a first component.

The term "and/or" includes any combination of a plurality of related listed items or any of the plurality of related listed items.

A blower 100 according to a first embodiment of the present disclosure will be described with reference to FIGS. 1 to 5. The blower 100 of the first embodiment may be provided in, for example, an outdoor unit of an air conditioner. Meanwhile, the blower 100 according to the first embodiment of the present disclosure may be provided not only in the outdoor unit but also in an indoor unit of the air conditioner.

As shown in the FIG. 1, the blower 100 according to the first embodiment is an axial flow fan, and includes a propeller fan 1 made of a resin material having one or a plurality of blades 12, a cylindrical-shaped shroud 2 disposed around the propeller fan 1, and a plasma actuator 3 installed in the shroud 2 and configured to generate an induced flow (IF) along an inner circumferential surface of the shroud 2.

The blower 100 according to the first embodiment includes a motor 4 for rotating the propeller fan 1, a power source 5 for applying a voltage to the plasma actuator 3, and a control unit 6 which is constituted by software and controls the power supply 5.

The propeller fan 1 includes a cylindrical hub 11 formed of a resin material and rotated by the motor 4 and provided at a central portion of the propeller fan 1, and three blades 12 provided on the outer peripheral surface of the hub 11 at regular intervals. The blade 12 has a shape curved in a helical shape along the direction of the rotation axis of the hub 11.

In the blower 100 according to the first embodiment, when the propeller fan 1 is rotated by the motor 4, airflow is formed along the axial direction (mainstream direction) of the propeller fan 1 from the lower side to the upper side in FIG. 1.

The shroud 2 is provided with a bell mouth 22 formed in a cylindrical shape and a flow reduction portion provided on the upstream side of the bell mouth 22 to reduce an area of a flow path through which airflow introduced by the propeller fan 1 flows and a diffuser 23 provided on the downstream side of the bell mouth 22 to enlarge the area of the flow path.

The bell mouth 22 is disposed such that its inner peripheral surface faces the outer peripheral end 13 of the blade 12 of the propeller fan 1.

A clearance is formed between the inner peripheral surface of the bell mouth 22 and the outer peripheral end 13 of the blade 12. The clearance may have a width of 1 mm or more and 100 mm or less along the radial direction of the bell mouth 22.

This clearance can be determined from the positional accuracy or assembly accuracy of the propeller fan 1 relative to the shroud 2.

The plasma actuator 3 generates plasma by a dielectric barrier discharge (DBD) to form an induced flow (IF) along the inner circumferential surface of the bell mouth 22.

Figure 2A:
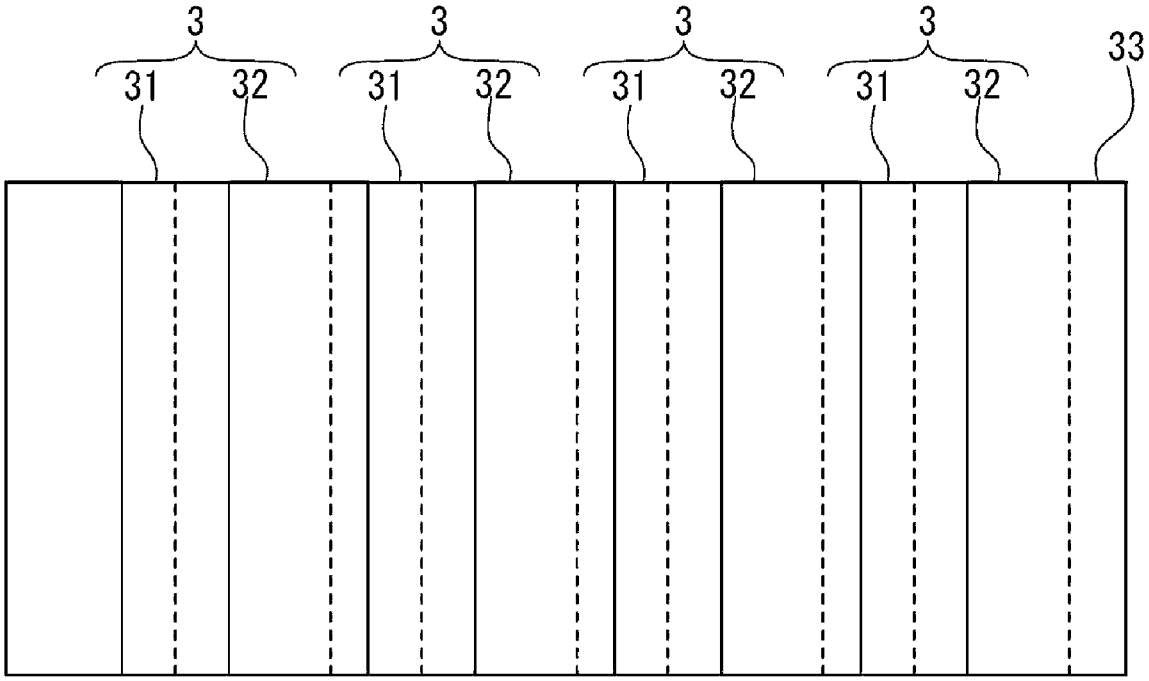
FIGS. 2*a* and 2*b* are views illustrating a configuration of a plasma actuator provided in the blower according to the first embodiment.
Figure 2B:
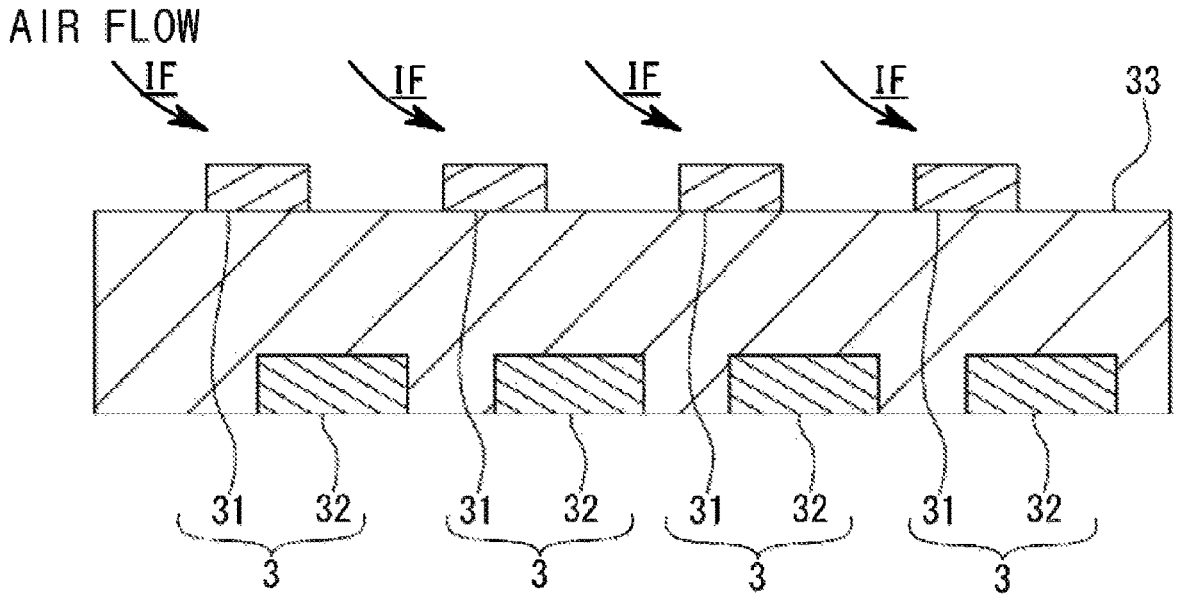

As shown in the FIGS. 2*a* and 2*b*, the plasma actuator 3 includes a pair of electrodes 31 and 32 connected to a power source 5 having a predetermined voltage and a predetermined frequency and a dielectric 33 formed between the pair of electrodes 31 and 32.

In the blower 100 according to the first embodiment, a plurality of plasma actuators 3 are aligned in the circumferential direction of the bell mouth 22, and each electrode included in each plasma actuator 3 is aligned in parallel with the inner circumferential surface of the bell mouth 22.

When the propeller fan 1 is projected on the inner circumferential surface of the shroud 2 in the radial direction of the shroud 2, the respective electrodes of the plasma actuator 3 are arranged so as to be located in the passage region of each blade 12.

The plasma actuator 3 is not provided on the inner peripheral surface of the flow reduction portion 21 of the shroud 2 in the blower 100 according to the first embodiment.

FIG. 2*a* is a plan view of a part of the inner circumferential surface of the bell mouth 22 according to the direction in which the electrodes are arranged, and FIG. 2*b* is a sectional view thereof.

As shown in the FIGS. 2*a* and 2*b*, each of the plasma actuators 3 includes a pair of electrodes 31 and 32. The pair of electrodes 31 and 32 includes a first electrode 31 provided on the inner peripheral surface of the bell mouth 22 and a second electrode 32 embedded in the bell mouth 22. The second electrode 32 is disposed outside the first electrode 31 along the radial direction of the shroud 2.

The first electrode 31 is exposed on the inner peripheral surface of the bell mouth 22 and the second electrode 32 is embedded in the bell mouth 22. Therefore, in the following description, the first electrode 31 will be referred to as an exposed electrode, and the second electrode 32 will be referred to as an embedded electrode.

As shown in FIGS. 1, 2*a* and 2*b*, the exposed electrode 31 is inclined with respect to the inner peripheral surface of the bell mouth 22 and extends obliquely with respect to the direction of the rotation axis of the hub 11.

The inclined or curved shape of the exposed electrode 31 corresponds to a shape formed when the outer peripheral end 13 of the blade 12 is projected on the inner peripheral surface of the bell mouth 22 in the radial direction of the bell mouth 22.

A layer of dielectric 33 is formed between the exposed electrode 31 and the embedded electrode 32.

The dielectric 33 is disposed on the outside of the exposed electrode 31 along the radial direction of the bell mouth 22 and the embedded electrode 32 is disposed on the outside of the dielectric 33. That is, the exposed electrode 31, the dielectric 33, and the embedded electrode 32 are arranged in order along the radial direction of the bell mouth 22.

A central axis passing through the center of the exposed electrode 31 and a central axis passing through the center of the embedded electrode 32 are arranged to be shifted from each other along the arrangement direction of the electrodes.

A circumferential distance along the circumferential direction of the bell mouth 22 between the exposed electrode 31 and the embedded electrode 32 constituting one plasma actuator 3 is smaller than the distance to the adjacent other plasma actuator 3. The exposed electrode 31 and the embedded electrode 32 are arranged so as to generate an induced flow (IF) in one direction.

In addition to the arrangement structure of the plasma actuator 3, any arrangement that can generate the induced flow (IF) in one direction is applicable.

As shown in the FIGS. 2*a* and 2*b*, the exposed electrode 31 and the embedded electrode 32 are arranged to overlap at least in a section along the circumferential direction of the bell mouth 22 so that the circumferential distance between the exposed electrode 31 and the embedded electrode 32 along the circumferential direction of the bell mouth 22 is zero, and the plasma actuators 3 adjacent to each other are arranged at regular intervals. Here, plasma is formed on the inner circumferential surface of the bell mouth 22 adjacent to the exposed electrode 31.

In the blower 100 according to the first embodiment, the exposed electrode 31 protrudes radially inward from the inner circumferential surface of the bell mouth 22 and is disposed within the clearance. The exposed electrode 31 is disposed so as to be spaced apart from the outer peripheral end 13 of the blade 12 by a predetermined distance.

A side surface of the exposed electrode 31 and a side surface of the embedded electrode 32 are arranged in parallel with the inner circumferential surface of the bell mouth 22 and the plurality of exposed electrodes 31 and the embedded electrodes 32 are alternately arranged along the circumferential direction of the bell mouth 22.

Each of the plurality of exposed electrodes 31 and the embedded electrodes 32 are disposed apart from each other along the circumferential direction of the bell mouth 22.

The power supply 5 has a plurality of independently controllable power supply systems. It is preferable that the plurality of power supply systems are configured to have the same number as the number of the plasma actuators 3 divided by the number of the blades 12. However, the number and type of power supply systems that can be independently controlled may be provided in various numbers and types.

The power source 5 is configured to apply a predetermined high-voltage, high-frequency AC voltage so as to generate plasma between the exposed electrode 31 and the embedded electrode 32. In the blower 100 according to the first embodiment, for example, the power source 5 may be configured to apply an AC voltage or a pulse voltage of 3 kV, 10 kH between the exposed electrode 31 and the embedded electrode 32.

The control unit 6 is configured to control the ON/OFF of the voltage of the plurality of plasma actuators 3 in synchronization with the rotation of the propeller fan 1.

For example, the control unit 6 acquires the current rotation angle of the propeller fan 1 from the encoder or armature current installed in the motor 4, and determines which of the plurality of plasma actuators 3 is to be driven in accordance with the rotation angle of the propeller fan 1 and apply the voltage of the power source 5 to the corresponding plasma actuator 3.

In the blower 100 according to the first embodiment, for example, the control unit 6 may operate the plasma actuator 3 closest to the outer peripheral end 13 of the blade 12 of the propeller fan 1.

Synchronization with the rotation of the propeller fan 1 means not only turning the voltage ON at a time when the outer peripheral end 13 of the blade 12 passes through the exposed electrode 31 but also turning the voltage ON at a predetermined time before or after the time when the outer peripheral end 13 of the blade 12 passes through the exposed electrode 31.

Hereinafter, the operation of the blower 100 will be described.

In the blower 100 according to the first embodiment, plasma is formed every time the outer peripheral end 13 of the blade 12 of the propeller fan 1 passes the exposed electrode 31, an induced flow (IF) is formed along the inner peripheral surface of the bell mouth 22.

Figure 3:
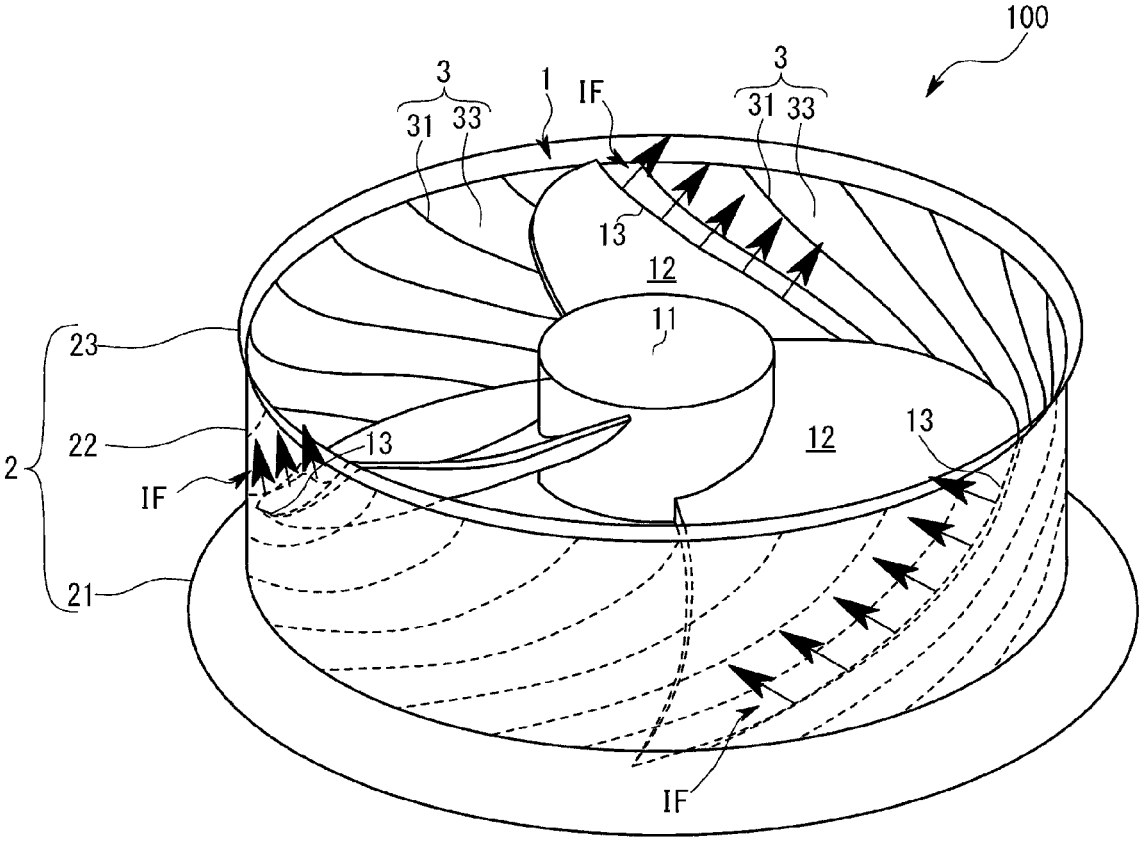
FIG. 3 is a perspective view illustrating an operation of the blower according to the first embodiment.

As shown in the FIG. 3, the induced flow (IF) is formed along the inner circumferential surface of the bell mouth 22 in a direction perpendicular to the outer peripheral end 13 of the blade 12. That is, the induced flow (IF) is formed as a flow having an axial component and a circumferential component along the inner peripheral surface of the bell mouth 22.

The suppression effect of the leakage flow by the induced flow (IF) formed as described above will be described in comparison with a conventional induced flow (IF) which is formed in the radial direction.

Figure 4A:
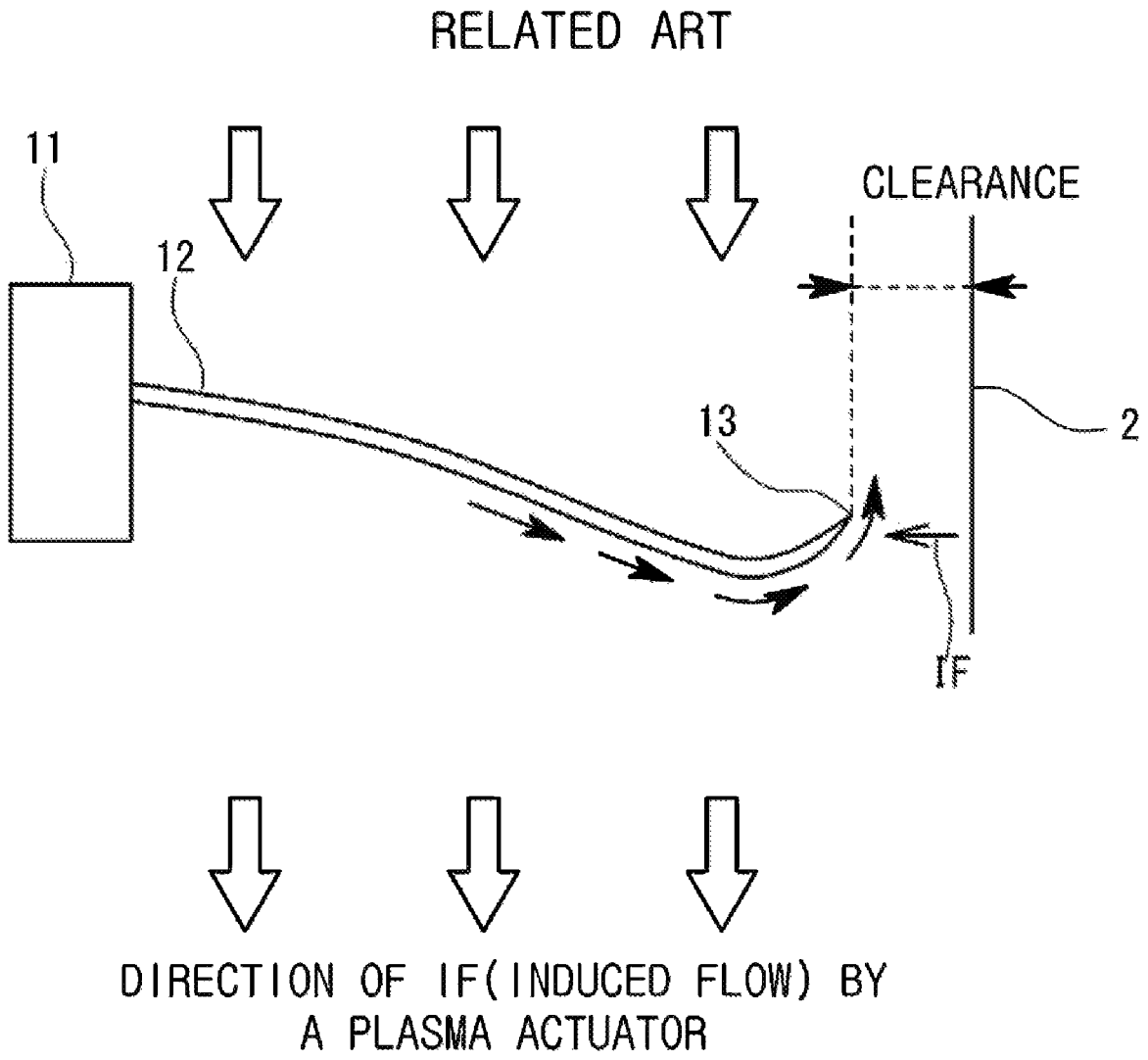
FIGS. 4*a* and 4*b* are views illustrating a flow of the induced flow (IF) by a plasma actuator in the conventional art.
Figure 4B:
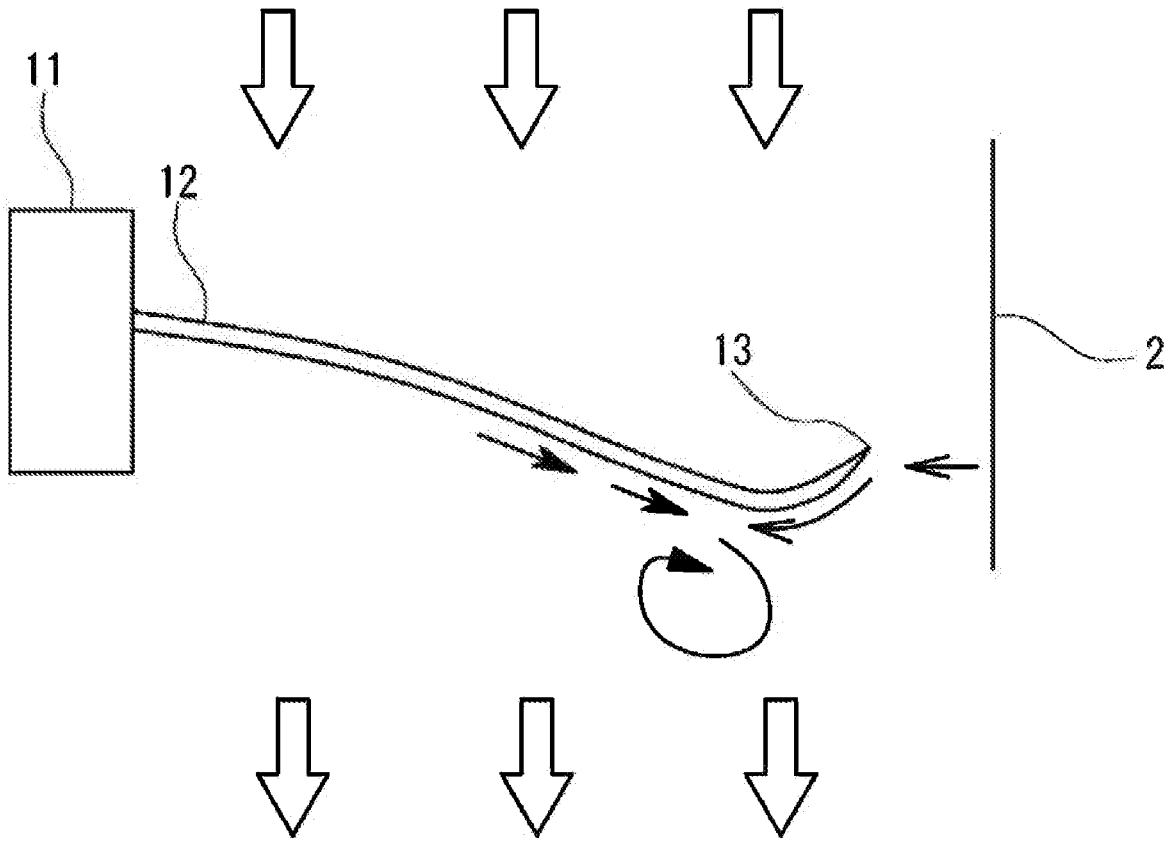
FIG. 4B RELATED ART

As shown in FIGS. 4*a* and 4*b*, conventionally, a high-voltage, high-frequency AC voltage is applied between a propeller fan 1 having a metal material and a coating wire provided on the inner circumferential surface of the shroud 2 to form plasma, an induced flow (IF) flowing in the radial direction of the shroud 2 is formed. In this configuration, plasma is not generated unless the clearance between the outer peripheral end 13 of the propeller fan 1 and the inner peripheral surface of the shroud 2 is set very small, and thus the induced flow (IF) flowing in the radial direction is not formed.

And as shown in FIGS. 4*a* and 4*b*, the induced flow (IF) flowing in the radial direction also flows on the outer peripheral end 13 of the blade 12, so that the leakage flow is suppressed. However, air cannot be pushed out at the outer peripheral end of the blade 12 where the flow of air is the fastest, which causes a decrease in the efficiency of the blower.

Figure 5A:
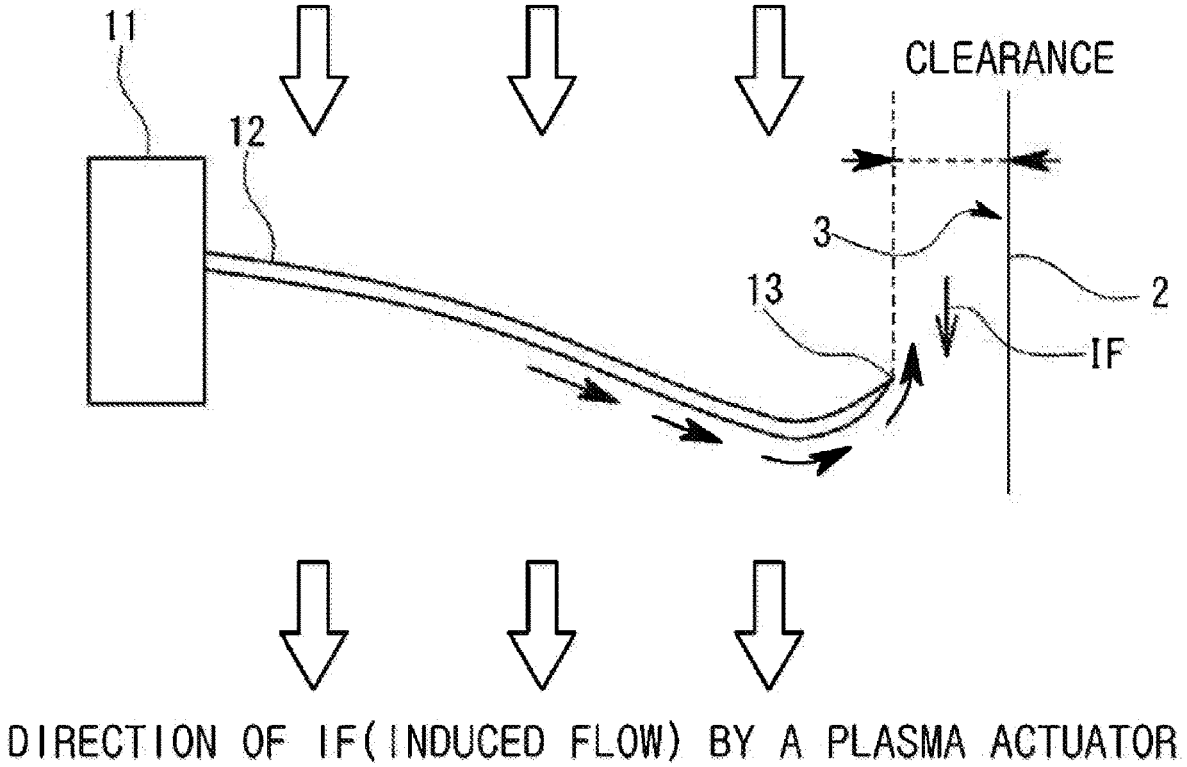
FIGS. 5*a* and 5*b* are views illustrating a flow of the induced flow (IF) by the plasma actuator provided in the blower according to the first embodiment.
Figure 5B:
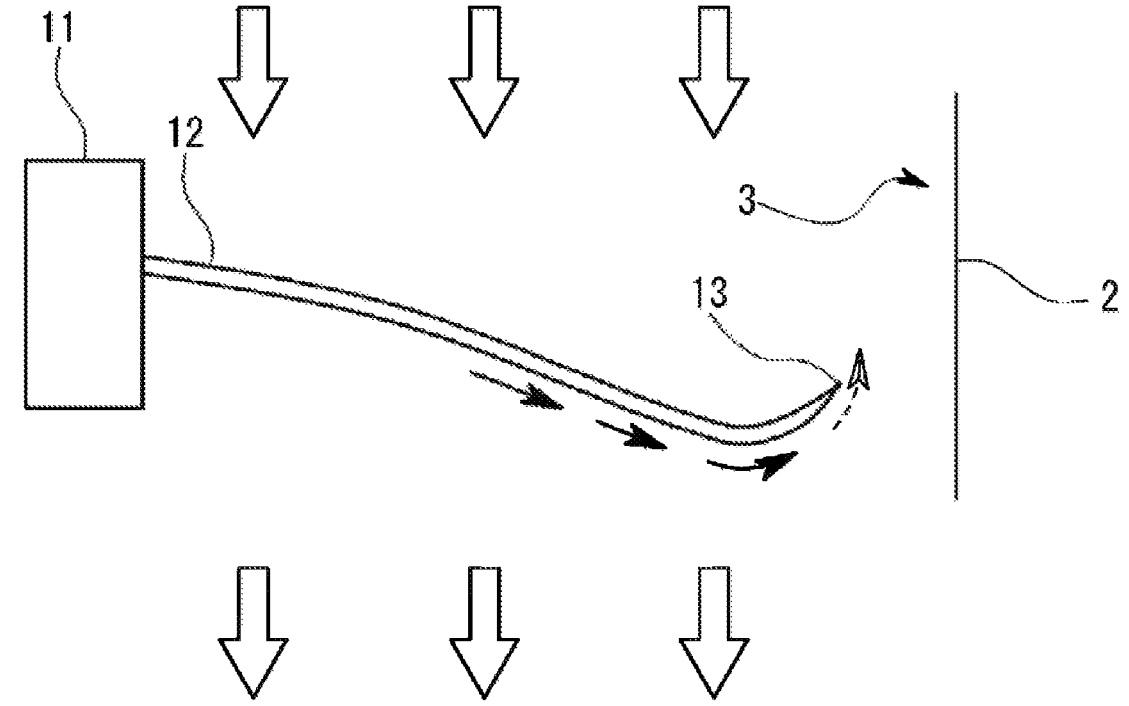

As shown in FIGS. 5*a* and 5*b*, in the blower 100 according to the first embodiment, a pair of the exposed electrodes 31 and the embedded electrodes 32 are formed on the inner peripheral surface of the bell mouth 22, the induced flow (IF) flows in the clearance along the inner peripheral surface of the bell mouth 22.

Therefore, as shown in FIGS. 5*a* and 5*b*, since the flow of air formed by the blades 12 and the induced flow (IF) are opposite to each other in the clearance, it is possible to obtain only the suppression effect of the leakage flow.

And whether or not plasma can be formed by the plasma actuator 3 is independent of the size of the clearance, and therefore, a clearance larger than that of the conventional structure shown in FIGS. 4*a* and 4*b* can be set. Therefore, it is not necessary to strictly regulate dimensions of elements constituting the blower 100 or the assembly accuracy between the elements, and therefore, the plasma actuator 3 can be installed at a low cost.

Further, by effectively suppressing the leakage flow by the induced flow (IF) generated by the plasma actuator 3, the efficiency of the blower 100 is improved and the noise is reduced.

Next, a first modified embodiment of the blower 100 according to the first embodiment will be described.

As shown in FIGS. 2*a* and 2*b*, the blower 100 according to the first embodiment has a structure in which the exposed electrode 31 is provided on the inner peripheral surface of the bell mouth 22.

Figure 6A:
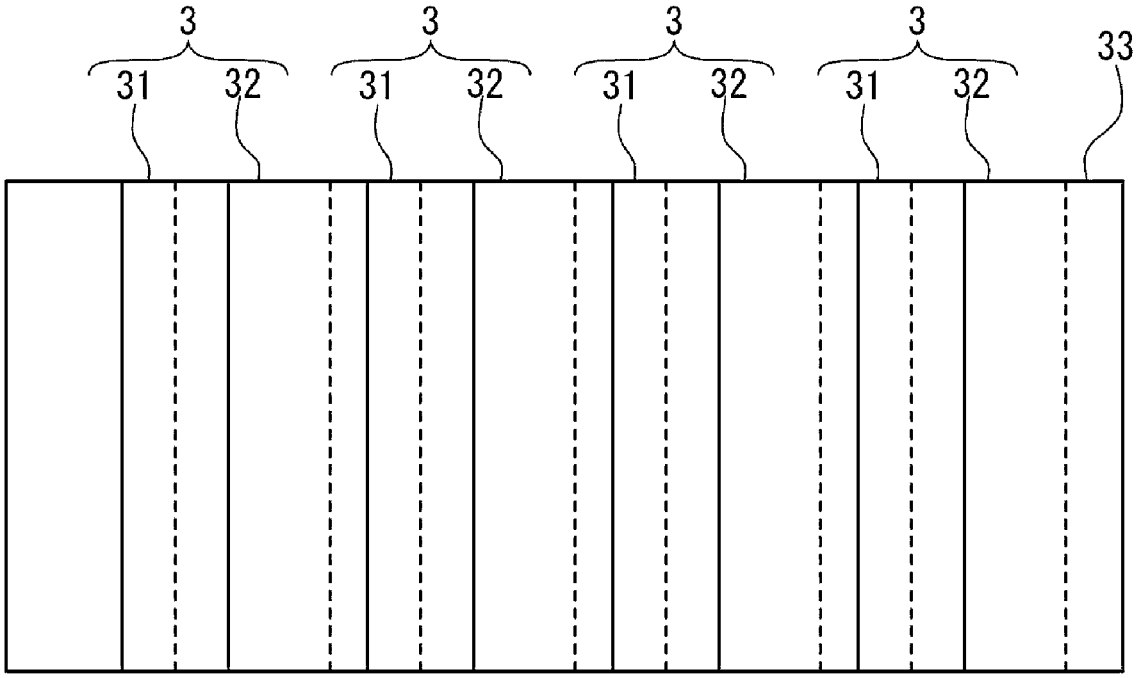
FIGS. 6*a* and 6*b* are views illustrating a first modified embodiment of the plasma actuator provided in the blower according to the first embodiment.
Figure 6B:
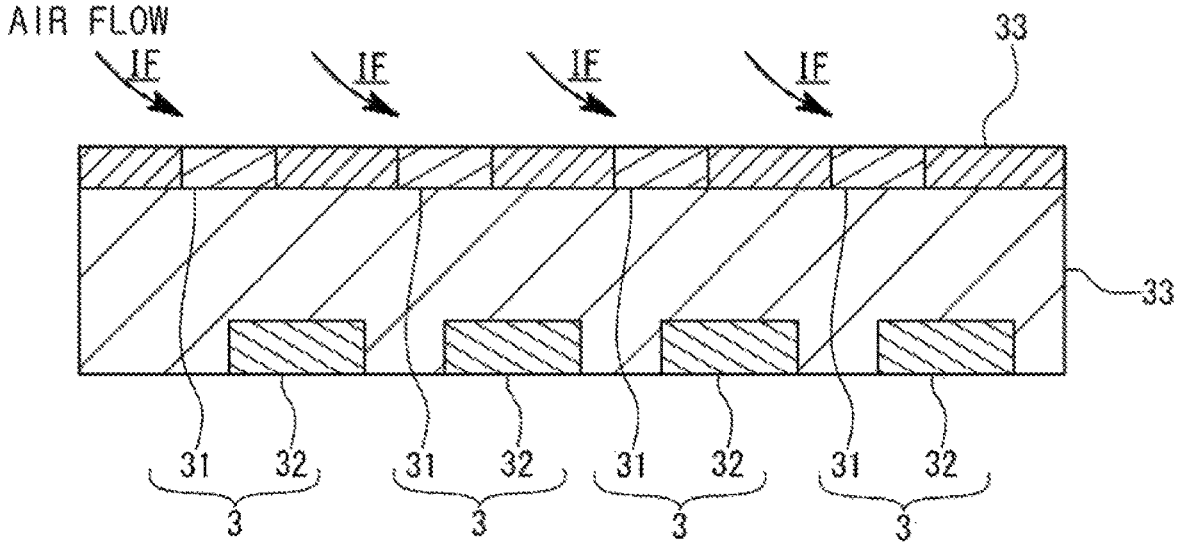

However, in the first modified embodiment of the blower 100, as shown in FIGS. 6*a* and 6*b*, one surface of the exposed electrode 31 is provided so as to coincide with the inner peripheral surface of the bell mouth 22. Specifically, spaces between the plurality of exposed electrodes 31 are filled with the dielectric 33 or another resin or the like to form the inner peripheral surface of the bell mouth 22.

In the structure in which one surface of the exposed electrode 31 coincides with the inner peripheral surface of the bell mouth 22, as compared with the structure in which the exposed electrode 31 protrudes from the inner peripheral surface of the bell mouth 22 in a convex or concaved shape, disturbance of airflow is less likely to occur, and therefore, high efficiency and low noise can be realized.

Next, a second modified embodiment of the blower 100 according to the first embodiment will be described.

Figure 7A:
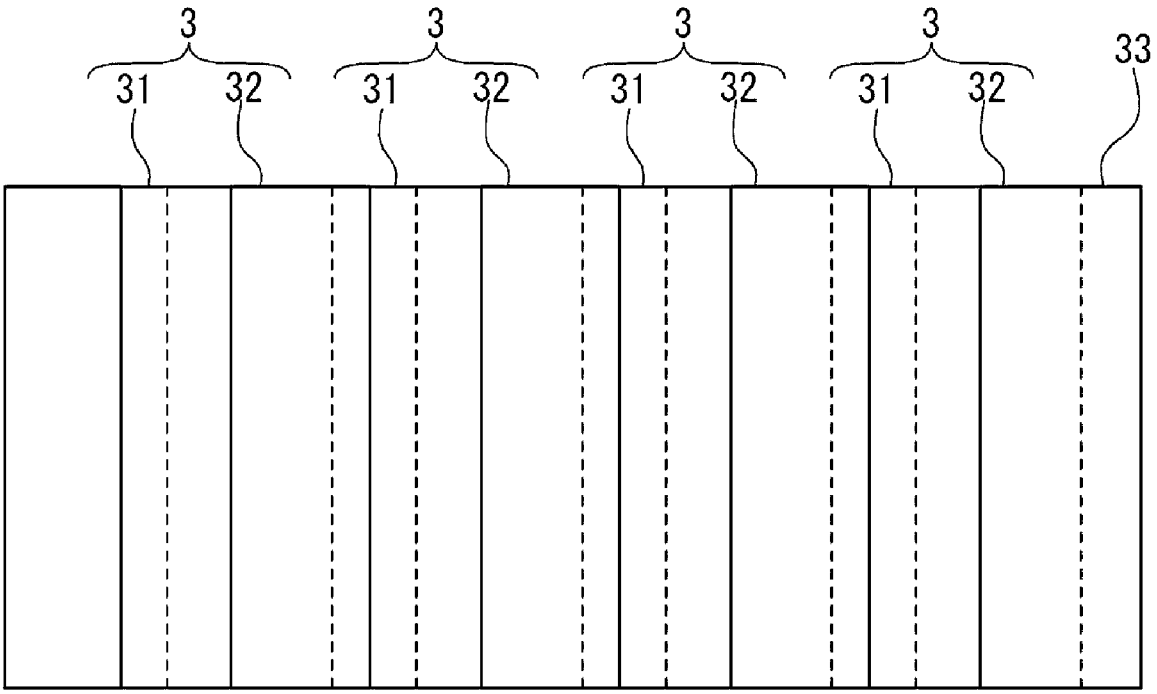
FIGS. 7*a* and 7*b* are views illustrating a second modified embodiment of the plasma actuator provided in the blower according to the first embodiment.
Figure 7B:
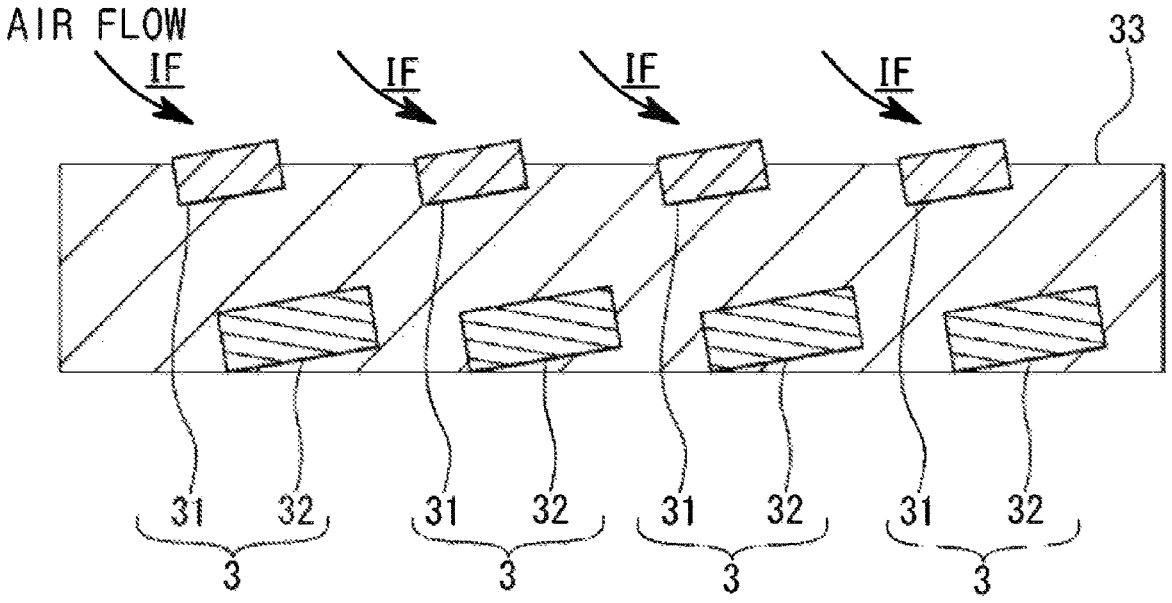

As shown in FIGS. 7*a* and 7*b*, in the second modified embodiment of the blower 100, one surface of the exposed electrode 31 and one surface of the embedded electrode 32 are formed to be inclined so as to intersect the inner peripheral surface of the bell mouth 22.

And in the second modified embodiment of the blower 100, a portion of the exposed electrode 31 is accommodated in the inner peripheral surface of the bell mouth 22. That is, the bell mouth 22 includes a receiving groove to receive a portion of the radially outer side of the exposed electrode 31.

A portion of the radially inner side of the exposed electrode 31 is not accommodated in the receiving groove but protrudes from the inner peripheral surface of the bell mouth 22.

In the structure in which a portion of the exposed electrode 31 is accommodated in the inner peripheral surface of the bell mouth 22 as described above, the plasma actuator 3 forms the induced flow (IF) along the inner peripheral surface of the bell mouth 22, so that the leakage flow of the propeller fan 1 can be suppressed. In addition, by increasing an exposed area of the exposed electrode 31, it is possible to reduce resistance due to the air flow while maintaining plasma generation.

Next, a blower 100 according to a second embodiment of the present disclosure will be described with reference to FIGS. 8*a* and 8B.

The blower 100 according to the first embodiment has a structure in which the exposed electrode 31 and the embedded electrode 32 of the plasma actuator 3 are arranged along the circumferential direction of the shroud 2, the induced flow (IF) generated by the plasma actuator 3 flows in a direction perpendicular to the peripheral end 13 of the blade 12.

On the other hand, in the blower 100 according to the second embodiment, the exposed electrode 31, the embedded electrode 32, and the dielectric 33 of the plasma actuator 3 are formed in a ring shape and aligned in only one set in the direction of the rotational axis of the hub 11.

That is, in the blower 100 according to the second embodiment, the plasma actuator 3 provided at the bell mouth 22 forms a induced flow (IF) flowing in the axial direction along the inner peripheral surface of the bell mouth 22.

In the blower 100 according to the second embodiment, the structure of the pair of electrodes constituting the plasma actuator 3 can be simplified. In addition, it is possible to form a cylindrical induced flow (IF) flowing in a direction crossing the outer peripheral end 13 of the blade 12. Therefore, by interfering with the induced flow (IF) having a counter flow against the leakage flow, the leakage flow can be effectively suppressed.

Figure 8A:
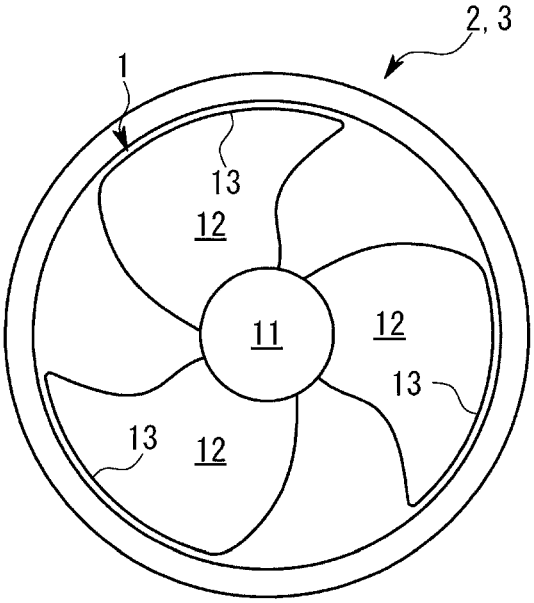
FIGS. 8*a* and 8B are views illustrating a blower according to a second embodiment of the present disclosure.
Figure 8B:
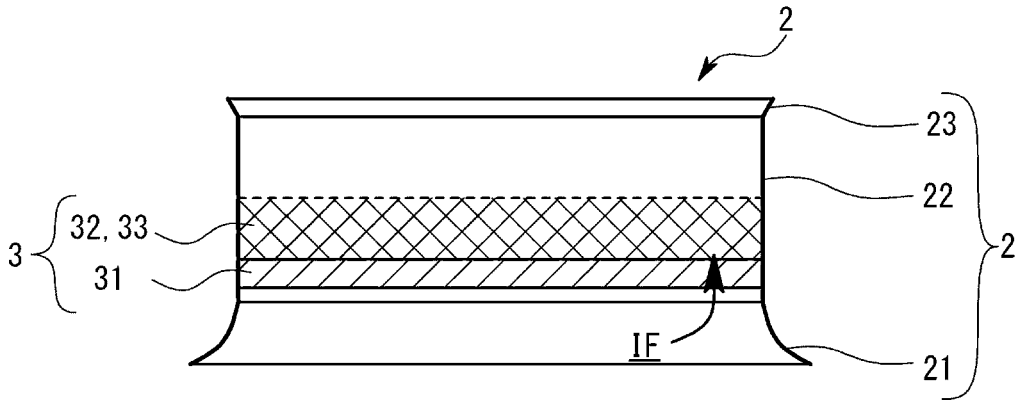

On the other hand, although a set of plasma actuator 3 is provided in the blower 100 according to the second embodiment shown in FIGS. 8*a* and 8B, a plurality of sets of plasma actuators 3 may be provided.

Figure 9:
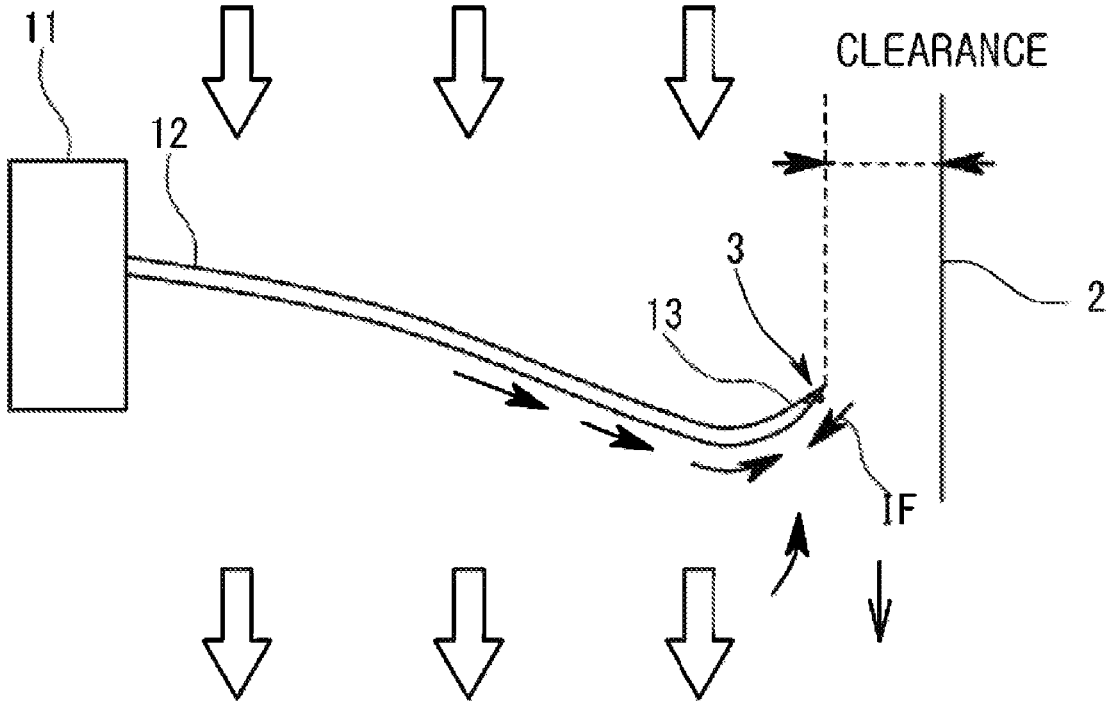
FIG. 9 is a view illustrating a blower according to a third embodiment of the present disclosure.

Next, a blower 100 according to a third embodiment of the present disclosure will be described with reference to FIG. 9.

In the blower 100 of the third embodiment, the plasma actuator 3 is installed only in the propeller fan 1.

That is, a set of the exposed electrodes 31 and the embedded electrodes 32 are formed along the outer peripheral end of the blade 12 of the propeller fan 1, and the induced flow (IF) is generated on the outer peripheral end of the blade 12.

In the structure in which the plasma actuator 3 is installed in the propeller fan 1, since the induced flow (IF) can be formed directly on the outer peripheral end of the blade 12 where the leakage flow occurs, so that the suppression effect of the leakage flow can be obtained even with the small induced flow (IF).

Other embodiments will be described below.

In each embodiment, an air conditioner is exemplified as an application example of the blower according to the present disclosure, but it is also possible to apply the blower according to the present disclosure to electronic products having other blowing applications.

The plasma actuator is not limited to forming an induced flow (IF) by generating plasma by a pair of parallel electrodes.

A pair of electrodes for forming plasma in the plasma actuator may be installed only in one of the shroud and the propeller fan to generate plasma regardless of the size of the clearance.

In addition, the plasma actuator is not limited to forming an induced flow (IF) by dielectric barrier discharge, and it is also possible to form an induced flow (IF) by, for example, atmospheric pressure glow discharge.

The positional relationship and the magnitude relationship between the exposed electrode and the embedded electrode are not limited to the above-described structure as long as the structure can generate plasma.

The plasma actuator may be installed not only on the inner circumferential surface of the bell mouth but also on the inner circumferential surface of the diffuser. Further, the plasma actuator may be provided only on the inner peripheral surface of the diffuser.

The blower may be configured to perform an air cleaning function by using a sterilizing component or an air cleaning component of plasma generated in the plasma actuator.

As long as it is not contrary to the purpose of the present disclosure, it is possible to combine or modify the above-described various embodiments.

According to the present disclosure, in the blower installed in the air conditioner, the leakage flow is suppressed by the plasma actuator, so that the high efficiency and low noise can be achieved.

Further, since the plasma actuator can be installed in the blower at a low cost, the productivity of the blower and the air conditioner is improved.

Although a few embodiments of the present invention have been shown and described above, the invention is not limited to the aforementioned specific exemplary embodiments. Those skilled in the art may variously modify the invention without departing from the gist of the invention claimed by the appended claims.

What is claimed is:

1. An air conditioner having a blower, the blower comprising:

a fan having a hub and at least one blade extending radially from the hub, the at least one blade having an outer peripheral end that is curved along a rotational axis of the fan and positioned at an oblique angle to the hub;

a motor to connect to the hub and rotatably drive the hub;

a shroud configured to surround the outer peripheral end of the at least one blade so that the fan rotates along an inner circumferential surface of the shroud; and at least one actuator installed in the shroud in an area of a flow path between the outer peripheral end of the at least one blade and the shroud, a shape of a portion of the at least one actuator is formed to match a shape of the outer peripheral end of the at least one blade, wherein the at least one actuator is configured to form an airflow along the inner circumferential surface of the shroud to reduce the area of the flow path through which an airflow introduced by the at least one blade flows.

2. The air conditioner according to claim 1, wherein the at least one actuator includes:

a pair of electrodes; and a dielectric disposed between the pair of electrodes.

3. The air conditioner according to claim 2, wherein the pair of electrodes includes:

a first electrode provided on the inner circumferential surface of the shroud; and a second electrode embedded in the shroud, wherein the dielectric is disposed between the first electrode and the second electrode.

4. The air conditioner according to claim 3, wherein the first electrode and the second electrode are alternately arranged along a circumferential direction of the shroud.

5. The air conditioner according to claim 3, wherein the first electrode protrudes from the inner circumferential surface of the shroud.

6. The air conditioner according to claim 3, wherein the second electrode is disposed outside the first electrode along a radial direction of the shroud.

7. The air conditioner according to claim 3, wherein the at least one actuator is among a plurality of the actuators which are spaced apart from each other along a circumferential direction of the shroud.

8. The air conditioner according to claim 7, further comprising a plurality of power sources to apply a voltage to each of the plurality of actuators and wherein a control unit is configured to independently control the plurality of power sources.

9. The air conditioner according to claim 8, wherein the control unit is configured to apply a voltage to a power source closest to the outer peripheral end of the at least one blade of the fan among the plurality of power sources when the fan rotates.

10. The air conditioner according to claim 3, wherein the first electrode and the second electrode are disposed so as to overlap each other at least in a section along the circumferential direction of the shroud.

11. The air conditioner according to claim 3, wherein the first electrode extends obliquely with respect to a direction of the rotational axis of the fan.

12. The air conditioner according to claim 3, wherein the at least one blade is among a plurality of blades and the at least one actuator is among a plurality of the actuators, and the plurality of the actuators correspondingly include the first electrode which extends in parallel with an outer peripheral end of the plurality of blades, respectively.

13. The air conditioner according to claim 3, wherein the first electrode is disposed obliquely with respect to the inner circumferential surface of the shroud.

14. The air conditioner according to claim 13, wherein the shroud includes a receiving groove to receive at least a portion of the first electrode.

15. The air conditioner according to claim 2, wherein the pair of electrodes and the dielectric are aligned in an axial direction of the hub.

16. The air conditioner according to claim 1, wherein the shroud includes:

a bell mouth formed in a cylindrical shape;

a flow reducing portion provided on an upstream side of the bell mouth to reduce a flow path area; and a diffuser provided on a downstream side of the bell mouth to enlarge a flow path area.

17. The air conditioner according to claim 16, wherein the at least one actuator is provided on an inner peripheral surface of the bell mouth.

18. The air conditioner according to claim 1, wherein the at least one actuator is a plasma actuator configured to generate plasma by a dielectric barrier discharge (DBD).

19. The air conditioner according to claim 1, wherein the fan is made of a non-metal material and the non-metal material is a resin material.

20. A blower for an electronic appliance, the blower comprising:

a fan having a hub and at least one blade extending radially from the hub, the at least one blade having an outer peripheral end that is curved along a rotational axis of the fan and positioned at an oblique angle to the hub;

a motor to connect to the hub and rotatably drive the hub;

a shroud configured to surround the outer peripheral end of the at least one blade so that the fan rotates along an inner circumferential surface of the shroud; and at least one plasma actuator installed in the shroud in an area of a flow path between the peripheral end of the at least one blade and the shroud, a shape of a portion of the at least one plasma actuator is formed to match a shape of the outer peripheral end of the at least one blade, wherein the at least one plasma actuator is configured to form an airflow along the inner circumferential surface of the shroud to reduce the area of the flow path through which an airflow introduced by the at least one blade flows.

* * * * *